US008915502B2

(12) United States Patent
Pennerath

(10) Patent No.: US 8,915,502 B2
(45) Date of Patent: Dec. 23, 2014

(54) CONVERTIBLE SHOE FOR WALKING AND FOR ROLLER-SKATING, HAVING LATERALLY DEPLOYABLE WHEELS INCORPORATED IN ITS SOLE

(75) Inventor: Eddy Pennerath, Henriville (FR)

(73) Assignee: Decathlon, Villeneuve d'Ascq (FR)

( * ) Notice: Subject to any disclaimer, the term of this patent is extended or adjusted under 35 U.S.C. 154(b) by 352 days.

(21) Appl. No.: 13/499,337

(22) PCT Filed: Oct. 1, 2010

(86) PCT No.: PCT/FR2010/000655

§ 371 (c)(1),
(2), (4) Date: May 22, 2012

(87) PCT Pub. No.: WO2011/039435

PCT Pub. Date: Apr. 7, 2011

(65) Prior Publication Data

US 2012/0222329 A1 Sep. 6, 2012

(30) Foreign Application Priority Data

Oct. 2, 2009 (FR) ..... 09 04705

(51) Int. Cl.

| | |
|---|---|
| ***A63C 17/20*** | (2006.01) |
| ***A63C 17/02*** | (2006.01) |
| ***A43B 3/24*** | (2006.01) |
| ***A43B 5/16*** | (2006.01) |
| ***A63C 17/00*** | (2006.01) |

(52) U.S. Cl.

CPC ..... *A63C 17/20* (2013.01); *A63C 17/02* (2013.01); *A43B 3/246* (2013.01); *A43B 5/1633* (2013.01); *A63C 17/008* (2013.01)

USPC ..... 280/11.3; 280/11.19; 280/11.27

(58) Field of Classification Search

USPC ..... 280/7.17, 9, 30, 11.232, 11.3, 11.33, 280/816; 36/115

See application file for complete search history.

(56) References Cited

U.S. PATENT DOCUMENTS

| | | | | |
|---|---|---|---|---|
| 2,114,790 | A * | 4/1938 | Venables | 482/105 |
| 3,306,623 | A * | 2/1967 | Weitzner | 280/11.206 |

(Continued)

FOREIGN PATENT DOCUMENTS

| | | | |
|---|---|---|---|
| CN | 2306039 | Y | 2/1999 |
| DE | 29717652 | U1 | 11/1997 |
| FR | 2823128 | A3 | 10/2002 |
| WO | 01/85271 | A1 | 11/2001 |

OTHER PUBLICATIONS

European Patent Office, Written Opinion of the International Searching Authority in International Application No. PCT/FR2010/000655, dated Mar. 1, 2011.

(Continued)

*Primary Examiner* — J. Allen Shriver, II
*Assistant Examiner* — Jacob Meyer
(74) *Attorney, Agent, or Firm* — Kenyon & Kenyon LLP

(57) ABSTRACT

The shoe has one to four wheels that, for walking, are placed horizontally in specific recesses in the sole, and that, for skating, are pivoted about longitudinal axes and blocked in a vertical position by a single latch, and project downwards relative to the sole, thereby transforming the shoe into a roller skate. This invention is of interest to manufacturers and users of shoes and of sports articles.

17 Claims, 8 Drawing Sheets

(56) References Cited

U.S. PATENT DOCUMENTS

| | | | | |
|---|---|---|---|---|
| 3,983,643 | A * | 10/1976 | Schreyer et al. | 36/115 |
| 5,398,970 | A * | 3/1995 | Tucky | 280/841 |
| 5,511,824 | A * | 4/1996 | Kim | 280/841 |
| 5,785,327 | A * | 7/1998 | Gallant | 280/11.27 |
| 5,797,609 | A * | 8/1998 | Fichepain | 280/11.19 |
| 5,803,469 | A * | 9/1998 | Yoham | 280/11.27 |
| 5,882,018 | A * | 3/1999 | Petrosino | 280/7.13 |
| 6,042,125 | A * | 3/2000 | Wu | 280/11.27 |
| 6,120,039 | A * | 9/2000 | Clementi | 280/11.19 |
| 6,343,800 | B2 * | 2/2002 | Clementi | 280/11.233 |
| 6,386,555 | B1 * | 5/2002 | Kao | 280/7.13 |
| 6,454,279 | B1 * | 9/2002 | Yang | 280/11.223 |
| 6,536,785 | B2 * | 3/2003 | Lee | 280/11.27 |
| 6,572,120 | B2 * | 6/2003 | Chang | 280/11.233 |
| 6,585,273 | B2 * | 7/2003 | Chiu | 280/11.223 |
| 6,629,698 | B2 * | 10/2003 | Chu | 280/11.19 |
| 6,634,656 | B1 * | 10/2003 | Gervasoni | 280/7.13 |
| 6,805,363 | B2 * | 10/2004 | Hernandez | 280/11.19 |
| 6,926,289 | B2 * | 8/2005 | Wang | 280/7.13 |
| 7,063,336 | B2 * | 6/2006 | Adams | 280/11.221 |
| 7,090,291 | B2 * | 8/2006 | Birchfield | 297/118 |
| 7,850,175 | B2 * | 12/2010 | Wegener | 280/11.19 |
| 8,505,930 | B2 * | 8/2013 | Niewohner | 280/11.223 |
| 2002/0125655 | A1 * | 9/2002 | Hsiao et al. | 280/11.19 |
| 2002/0145263 | A1 * | 10/2002 | Yang | 280/11.19 |
| 2002/0163143 | A1 * | 11/2002 | Hoag | 280/11.3 |
| 2005/0253349 | A1 * | 11/2005 | Birchfield | 280/30 |
| 2008/0235990 | A1 * | 10/2008 | Wegener | 36/100 |
| 2008/0256831 | A1 * | 10/2008 | Maiores | 36/115 |
| 2010/0308548 | A1 * | 12/2010 | Meers | 280/11.19 |

OTHER PUBLICATIONS

European Patent Office, International Search Report in International Application No. PCT/FR 2010/000655, dated Mar. 1, 2011.

* cited by examiner

CONVERTIBLE SHOE FOR WALKING AND FOR ROLLER-SKATING, HAVING LATERALLY DEPLOYABLE WHEELS INCORPORATED IN ITS SOLE

CROSS REFERENCE TO RELATED APPLICATION

This is a 371 national phase application of International Application No. PCT/FR2010/000655, filed Oct. 1, 2010, claiming priority to French application No. 09-04705, filed Oct. 2, 2009, the contents of which are incorporated herein by reference in their entirety.

The present invention relates to a shoe having wheels that are incorporated in the sole and that are unfoldable laterally by means of a mechanism. This shoe can serve in alternation for walking and for skating.

The present invention relates more particularly to shoes having one to four wheels that, for walking, are placed horizontally in specific recesses in the sole, and that, for skating, can be pivoted about longitudinal axes and blocked in a substantially vertical position in which they project downwards on either side of the sole, thereby transforming the shoe into a roller skate.

In everyday life, there are places and times at which it is necessary to walk easily, and others at which it is advantageous to be able to skate under good conditions, without having to change equipment or having to carry accessories.

It is thus useful to have shoes that are of aesthetically pleasing appearance and practical, but that are also convertible and make it possible to go easily from one mode of use to the other.

Document WO 01/85271 A1 discloses shoes that can be transformed into roller skates but that are relatively heavy and complex. Due to the in-line arrangement of the wheels, those shoes must extend above the ankle in order to protect and to support the foot. It is not easy to walk with that type of shoe, in which, furthermore, the sole is rendered rigid by the mechanism.

Document CN 2 306 039 Y also discloses shoes. The sole is relatively rigid because of the metal plate and it cannot deform freely during walking. The mechanism situated under the sole can become fouled with dirt, and the weight of the overall assembly is relatively high.

An object of the invention is to provide transformable shoes that are light in weight but robust, with thin and flexible soles that can deform freely during walking, with wheels of large diameter and a single and simple control device. The invention is thus adaptable to any type of shoes with or without the ankle being supported. The wheeled shoes of the invention make it possible to go very quickly and easily from walking to skating, and vice versa, and they are entirely suited to both uses.

In particular, depending on the use for which they are designed, it is possible to choose the diameter and the width of the wheels, the spacing between them, and their positions relative to the heel, the height of the sole relative to the ground in the skating position, the mechanism for fastening and for blocking the wheels, etc. Preferably, the sole equipped with the wheels presents towards the ground only surfaces that are closed and covered with rubber and that have only a low risk of being fouled with dirt.

The mechanism of the invention, serving to fasten the wheels to the shoe, enables the wheels to be blocked effectively and safely in the skating position and in the walking potion, without any slack or vibration, and makes it possible to go from one position to the other rapidly, effortlessly, and without requiring any tool.

To solve that technical problem, the invention provides a convertible shoe designed for walking and for roller-skating in alternation, said shoe comprising: a sole in which recesses are provided; roller skate wheels which, for walking, are retracted into a horizontal position inside the recesses in the sole, and, for skating, are deployed under the sole into a vertical position; and a mechanism for actuating the wheels making it possible to cause the wheels to go from one position to the other in alternation by lateral pivoting.

According to the invention, in the vertical position for skating, the wheels are disposed on either side of the sole in the manner of a roller skate.

In addition, the mechanism for actuating the wheels comprises:

- two longitudinal rods disposed one on either side of the shoe and fastened to the sole via bearings enabling them to pivot about their own axes, each of these longitudinal rods carrying the wheels that are situated on the same side of the shoe in such a manner as to constrain them to pivot therewith;
- two pivotally-mounted elements placed at the rear of the shoe, each of which is constrained to pivot with a respective one of the longitudinal rods, and is suitable for pivoting between two limit positions, one of which corresponds to the horizontal position of the wheels for walking, and the other of which corresponds to the vertical position of the wheels for skating; and
- an angular blocking device for angularly blocking the pivotally-mounted elements, which device, when it is unlocked releases the pivotally-mounted elements and allows them to pivot freely under the effect of gravity or of a force being exerted on the wheels, on the longitudinal rods or on the pivotally-mounted elements, and, when it is locked, blocks the pivotally-mounted elements simultaneously in one of their limit positions.

Other characteristics and advantages of the invention appear on reading the following detailed description. Equivalent elements shown in the various figures bear like numerical references.

The description is given with reference to the accompanying drawings, which show a preferred embodiment of the invention in the form of a shoe equipped with four roller skate wheels, and in which.

Figure 1:
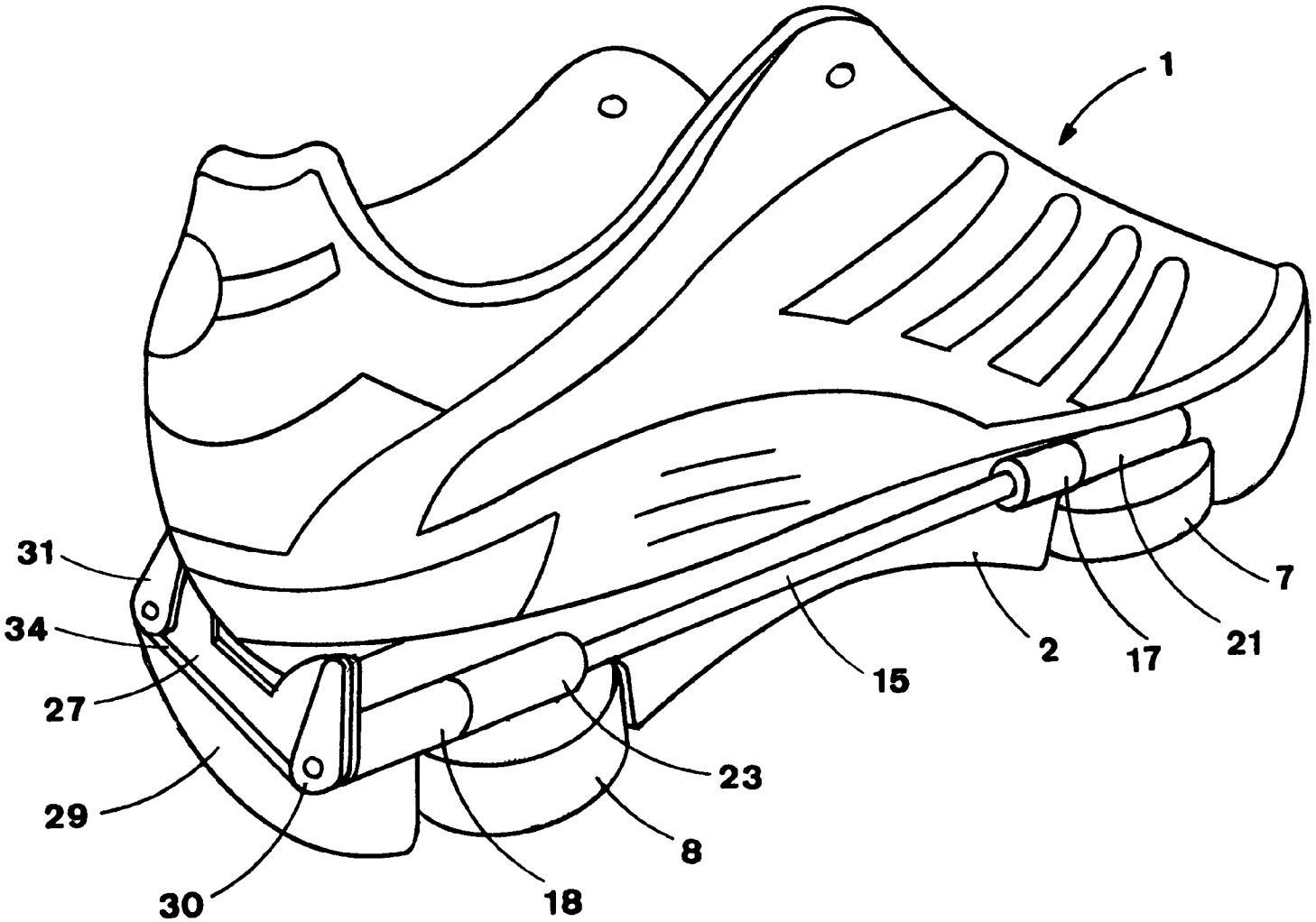
FIG. 1 is a perspective view of the shoe, seen from the inner side, with the wheels positioned horizontally for walking.
Figure 2:
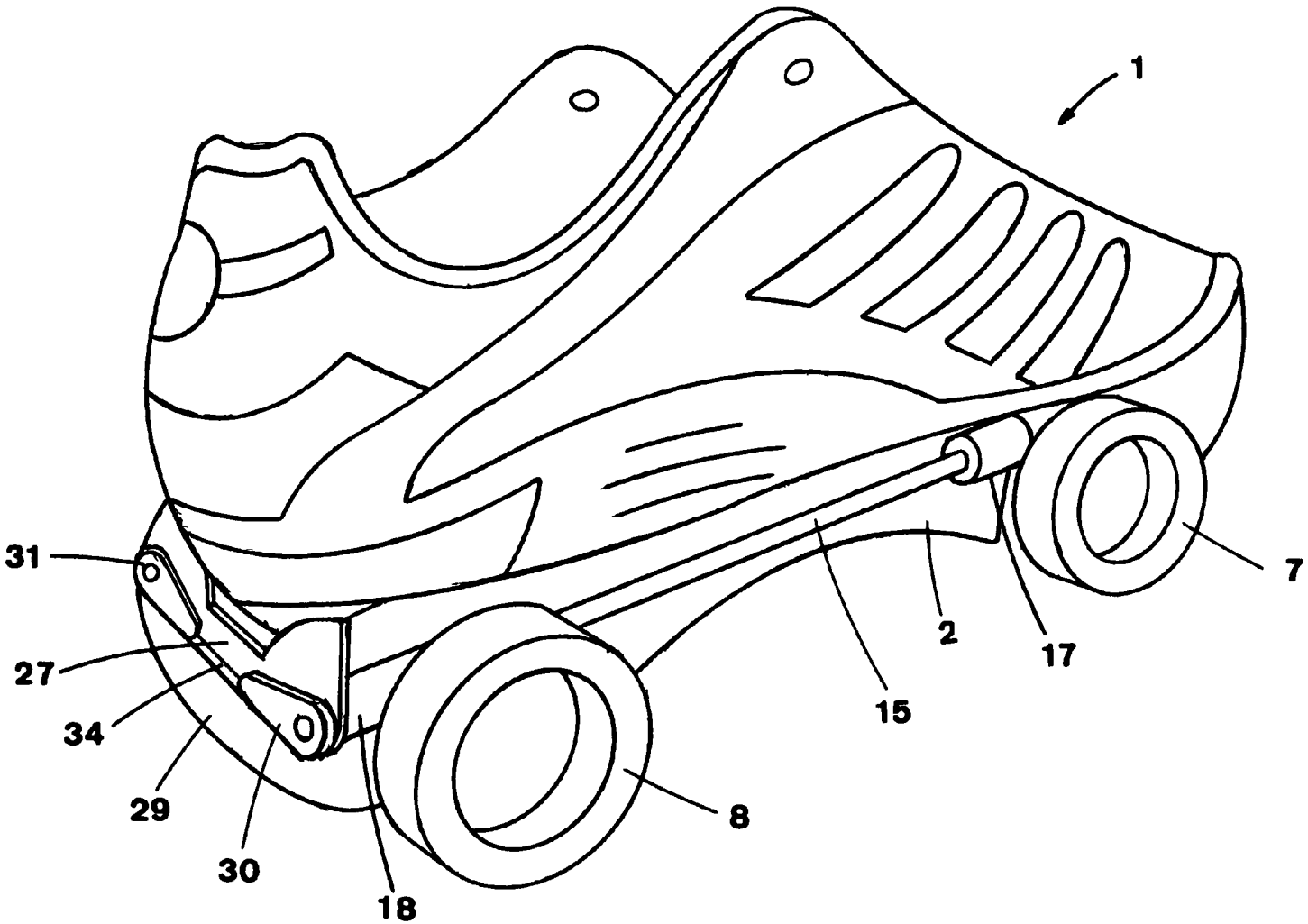
FIG. 2 is a perspective view of the shoe, seen from the inner side, with the wheels positioned vertically for skating.
Figure 3:
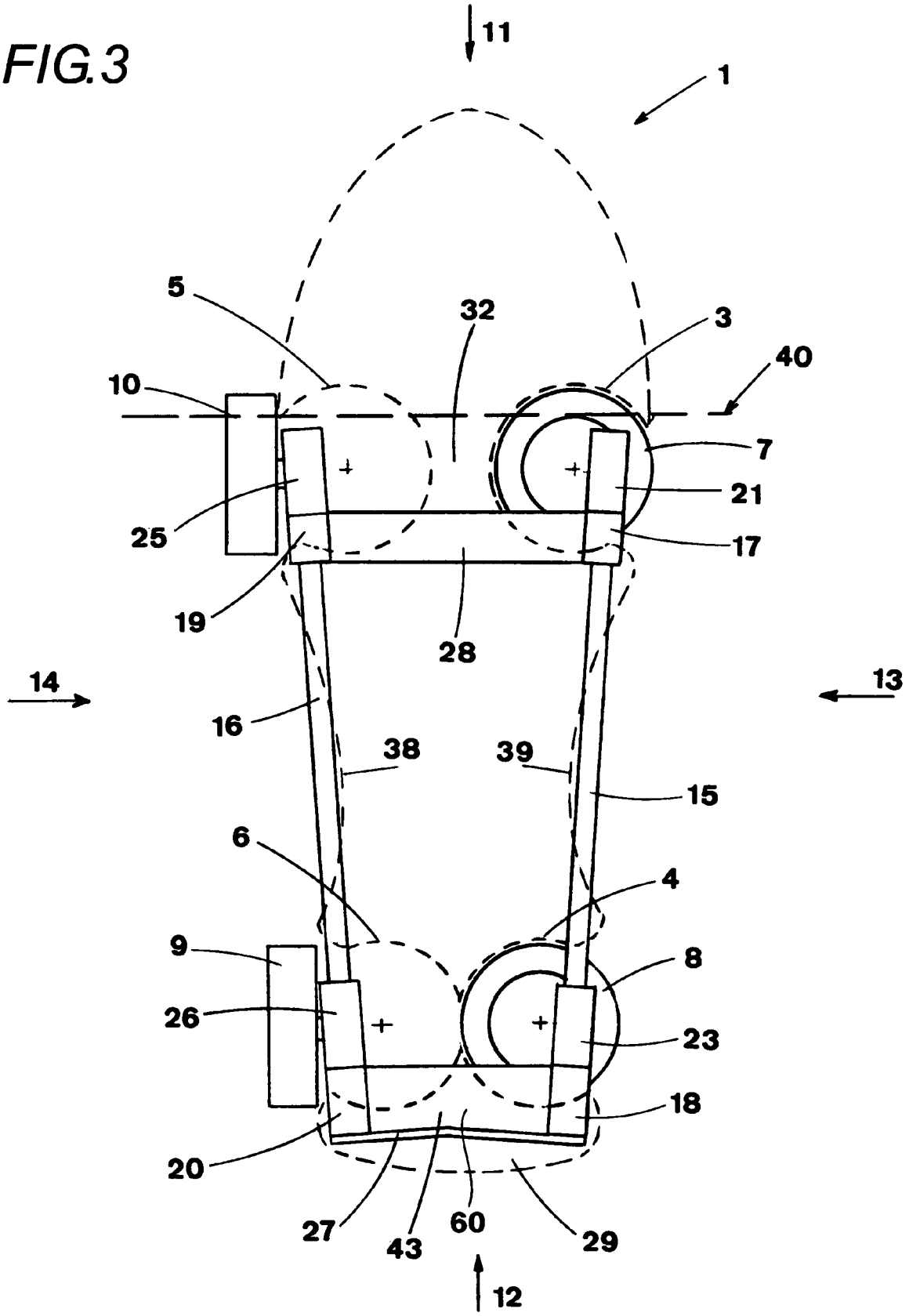
FIG. 3 is a view from above, without the sole and without the shoe; on the inner side 13, the wheels are in the horizontal position for walking; on the outer side 14, the wheels are in the vertical position for skating.
Figure 4:
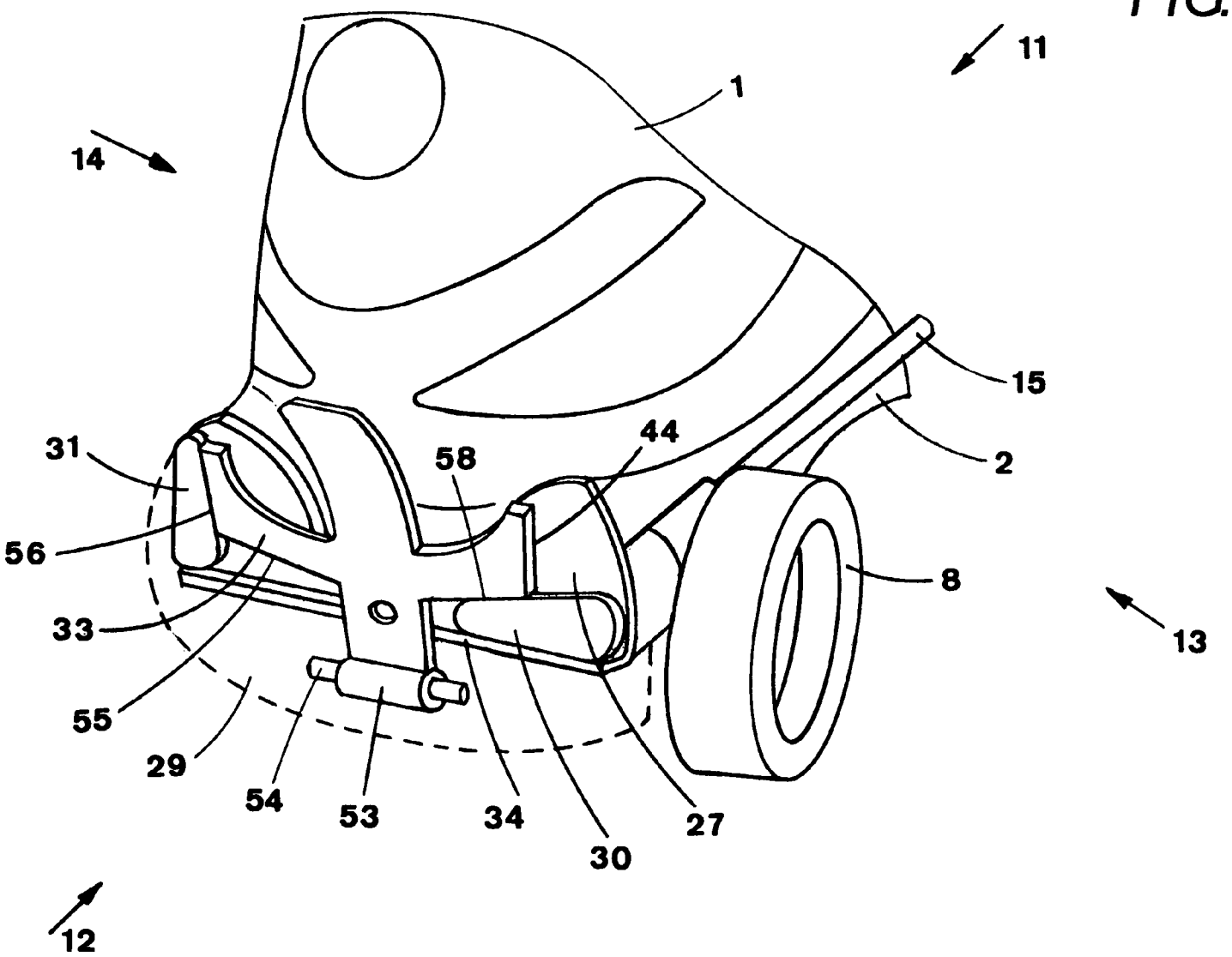
Figure 5:
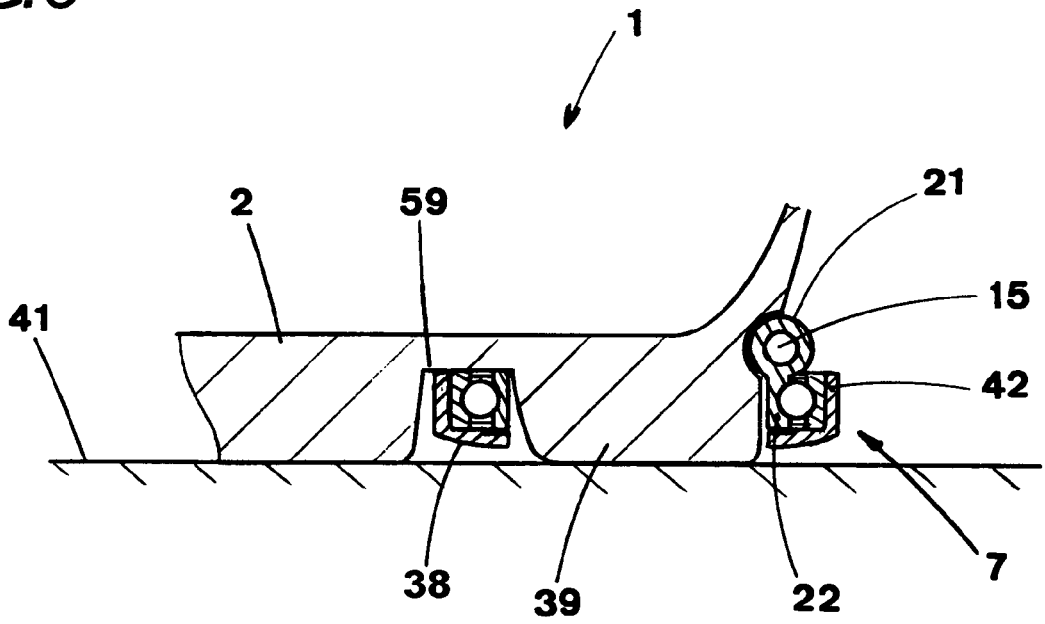
Figure 6:
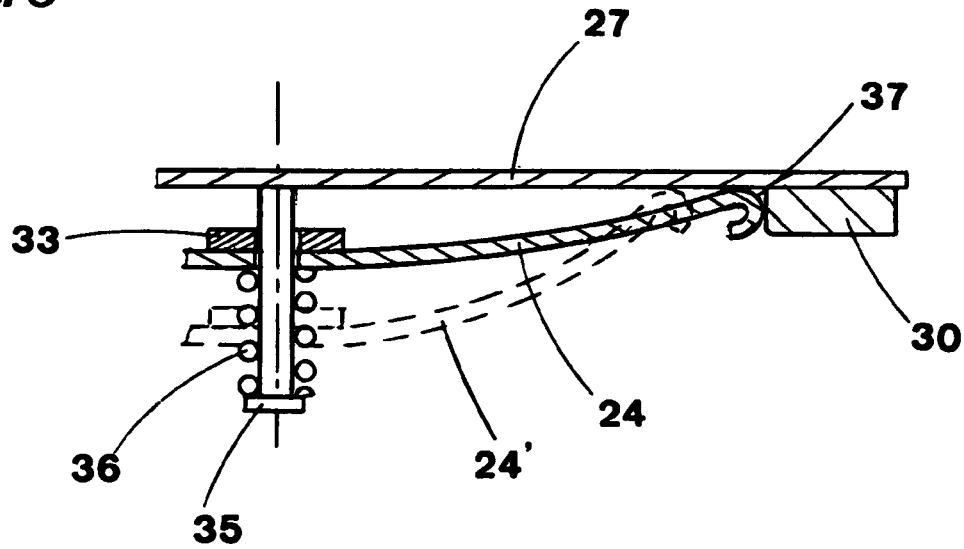
Figure 7:
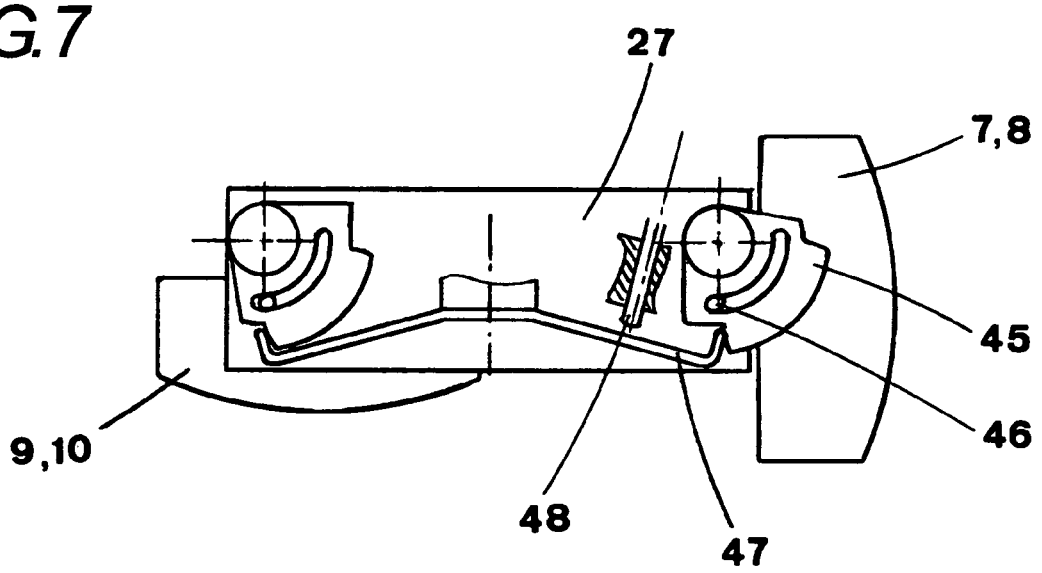
Figure 8:
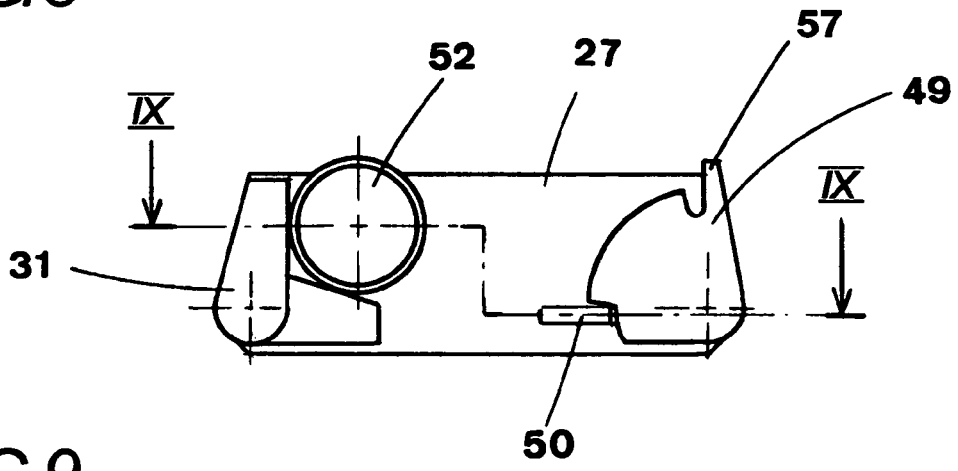
Figure 9:
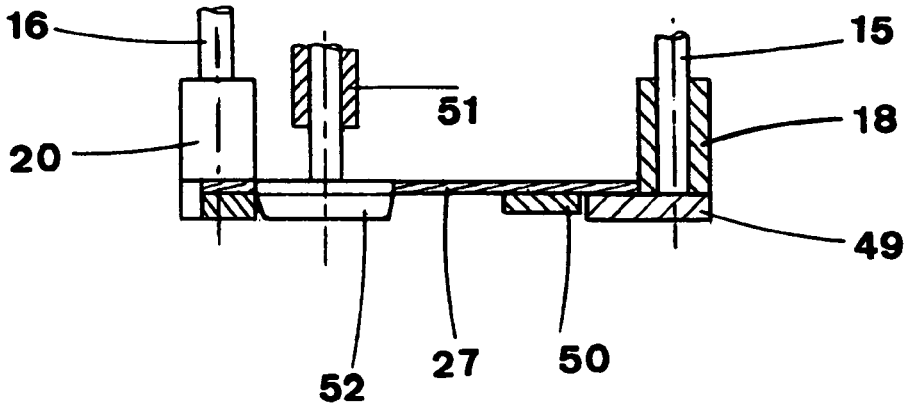
Figure 10:
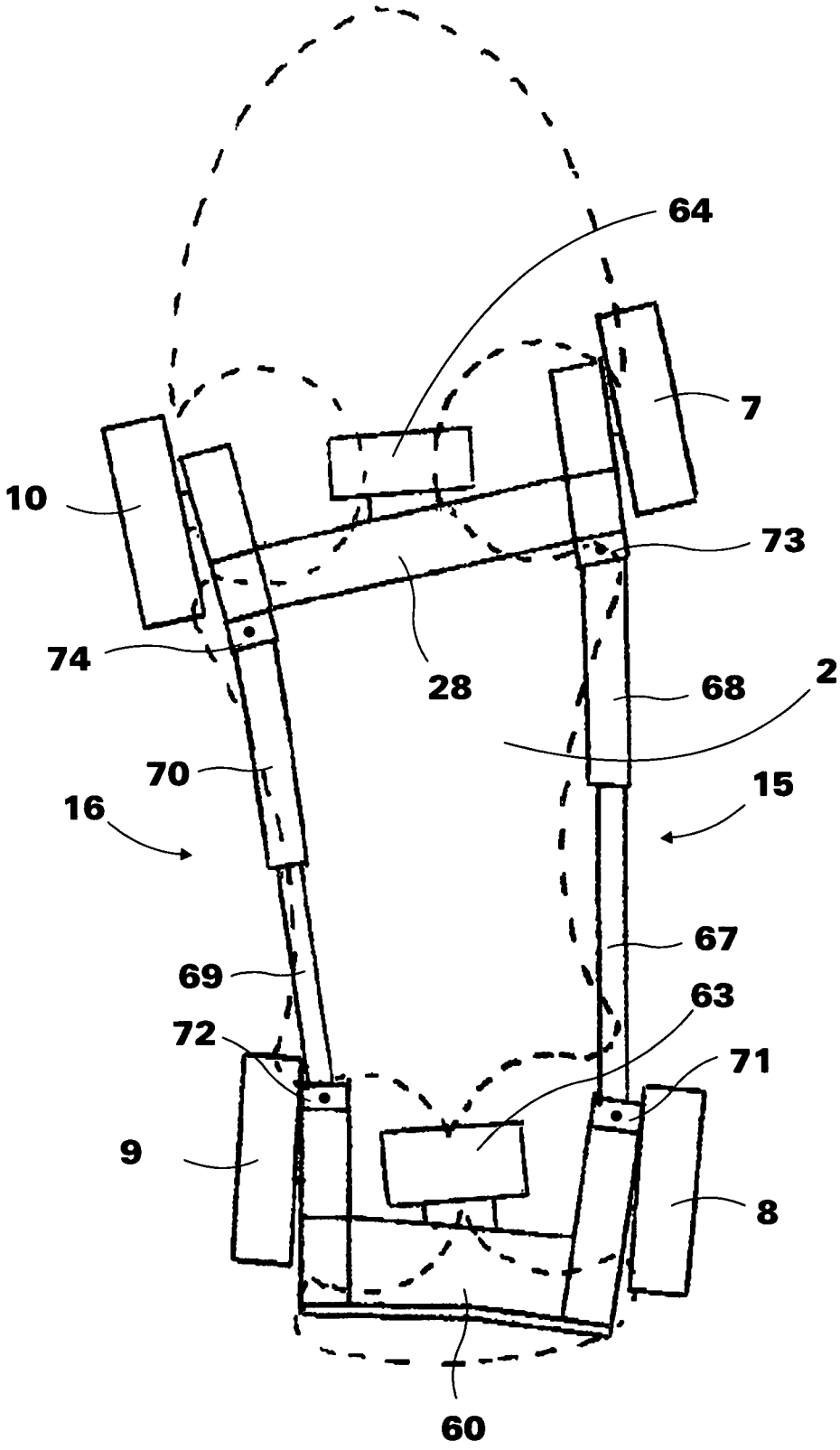
Figure 11:
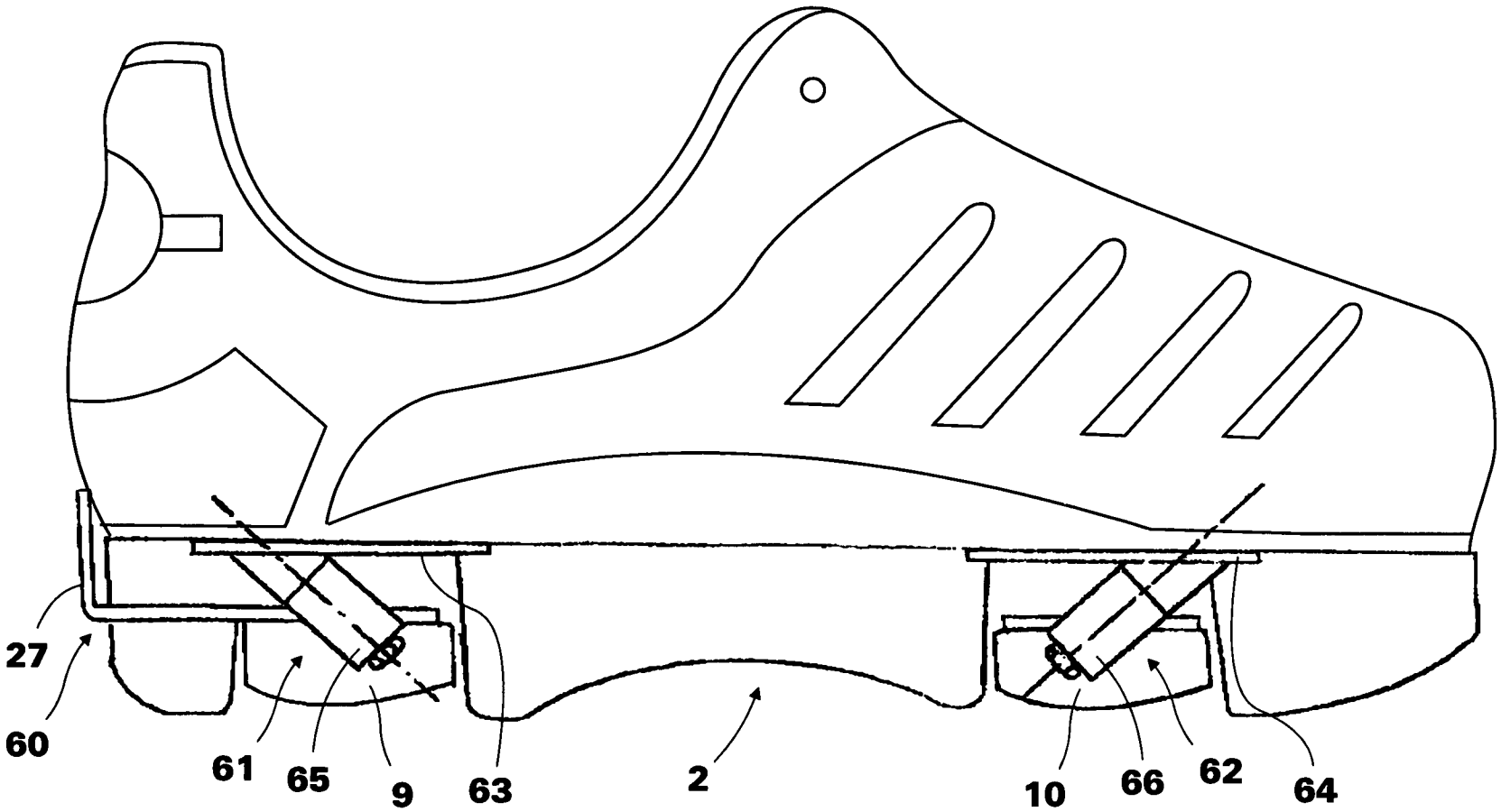

for reasons of simplification, the locking mechanism is not shown in full in FIGS. 1, 2 and 3;

FIG. 4 is a perspective view of the rear and of the inside of the blocking mechanism in a first variant of the invention; for reasons of simplification, not all of the components of the mechanism are shown;

FIG. 5 is a cross-section view through the sole and through the wheel 7, in the horizontal position;

FIG. 6 is a section view through the blocking mechanism in a second variant of the invention;

FIG. 7 is a view of the rear of the blocking mechanism in a third variant of the invention;

FIG. 8 is a view of the rear of the blocking mechanism; the left side corresponds to a fourth variant of the invention and the right side corresponds to a fifth variant of the invention;

FIG. 9 is a section view, on the section plane IX-IX of FIG. 8, showing details of the mechanism in the fourth and fifth variants of the invention;

FIG. 10 is a simplified diagrammatic plan view of a variant with steerable wheels; and FIG. 11 is a simplified diagrammatic view partially in longitudinal section, showing the variant with steerable wheels.

A convertible shoe 1 of the invention is described below in detailed manner with reference to the figures.

The shoe 1 includes a sole 2 having recesses 3, 4, 5, and 6 provided in the peripheral edge, each of which recesses is designed to receive a respective roller skate wheel 7, 8, 9, or 10. The example shown in the figures relates to a shoe equipped with four wheels, two of which, referenced 7 and 8, are placed on the inner side 13 of the shoe 1 and two of which, referenced 9 and 10, are placed on the outer side 14 of the shoe 1. But other variants relating to the number or to the arrangement of the wheels are possible. For example, it is possible to imagine a shoe with one inner wheel and two outer wheels, or vice versa.

In accordance with the invention, longitudinal rods 15 and 16, placed one on either side of the shoe, and preferably at the top of or above the sole 2, support the wheels situated on the same side, i.e. respectively the wheels 7 & 8 for the rod 16, and the wheels 9 & 10 for the rod 16 in the example shown, via their respective hubs 21, 23, 25, and 26.

The rods 15 and 16 extend generally longitudinally relative to the shoe and preferably substantially parallel to the outer and inner edges of the shoe 1.

The longitudinal rods 15 and 16 can pivot about their axes, thereby causing the wheels that they support to pivot with them. The hubs 21, 23, 25, 26 are constrained to pivot with the rods 15, 16 by means of fluting, of grooves, of splines, or of any other known means.

The rods 15 and 16 are guided in pivoting at the rear 12 by bearings 18 and 20 that are preferably connected to a rear plate 60 that is secured to the sole 2. This rear plate 60 may be a separate part mounted on the sole 2, or else it may be incorporated into said sole. The rear plate comprises a substantially vertical segment 27 disposed at the rear edge of the sole 2, and preferably a substantially horizontal segment 43 disposed under the rear portion of the sole 2.

The rods 15 and 16 are guided at the front 11 by bearings 17 and 19 that are preferably also connected to a plate 28 secured to the sole 2 and disposed under the front portion of the sole 2.

Each of the bearings 17, 18, 19, and 20 preferably includes a ball joint in such a manner as to enable the rods 15 to 16 to be movable angularly relative to the respective bearings 17 & 18 and 19 & 20. These ball joints may be replaced by flexible connections between the bearings 17 & 19 and the plate 28, and between the bearings 18 & 20 and the plate 60. Enabling the rods 15, to move angularly advantageously procures high flexibility for the sole and allows it to be deformed freely during walking, without exerting stresses on the rods or on their bearings.

Thus, by pivoting, the rods 15 and 16 cause the wheels that are secured to them to pivot simultaneously, and the ball-joint bearings 17, 18, 19, and 20 guarantee that this takes place properly regardless of any deformation of the sole 2.

Given that the shoe is conventionally wider at the front than at the rear, the rods 15 and 16 are generally spaced further apart at the front than at the rear, as shown in FIG. 3. As a result, the connections between the rims 22 and the hubs 21, 23, 25, 26 are implemented in such a manner that the wheels are mutually parallel, and parallel to the front-to-rear direction 11-12 when they are in the vertical position for skating. In order to compensate for this lack of parallelism between the wheels 7 & 8 and 9 & 10 and the rods 15 & 16, the recesses for receiving the wheels preferably have end walls 59 that are inclined relative to the ground 41 and to the sole 2.

The plate 60 is preferably made as a single piece. The plate 28 may also be in a single piece or else be made up of two independent elements that are fastened separately to the sole on the left and on the right.

For example, the plates 60 and 28 are made as a stamped sheet metal, as a molded casting, or out of injection-molded plastic, and they are molded onto the sole 2 while said sole is being made. They may also be incorporated into the sole 2, i.e. molded integrally with the sole out of a suitable plastics material.

FIGS. 1 and 2 show the substantially vertical portion referred to as a "segment" 27 of the rear plate 60. This vertical portion is situated in a zone of the shoe 1 that is protected from impacts and from contact with the ground 41. It may advantageously serve as a support for the angular blocking device that blocks the pivotally-mounted assemblies angularly.

Pivotally-mounted elements 30 and 31 are constrained to pivot with respective ones of the rods 15 and 16. This may be achieved by any known means, such as grooves, fluting, splines, pins, etc. In the first variant of the invention, each pivotally-mounted element 30 or 31 is of substantially elongate shape. It is directed upwards when the wheels 7, 8, 9, and 10 are in the horizontal position for walking as shown in FIG. 1. It is situated substantially horizontally when the wheels are in the vertical position for skating (FIG. 2). In this horizontal position, each pivotally-mounted element 30, comes into abutment against an abutment element 34 that is preferably secured to the segment 27.

FIG. 4 shows a preferred first variant of the angular blocking device, with, on the inner side 13, the skating position, and, on the outer side 14, the walking position. A latch 33 is hinged at its base, via a hub 53 that is secured to it or integral with it, to pivot about a pin 54 secured to the plate 60. The latch 33 is pressed against the segment 27 by a spring 36 (not shown in this view). On either side, the latch 33 has a substantially vertical bearing side surface, respectively 56 and 44, coming to bear against one of the pivotally-mounted elements 31 or 30. Also on either side, the latch 33 has respective bottom bearing surfaces 55 and 58 designed to block each of the pivotally-mounted elements 31, 30 in the horizontal position.

Other angular positions for the pivotally-mounted elements 30, 31 are possible in accordance with the invention, provided that the angular offset between the walking position and the skating position is substantially equal to 90°.

In a preferred embodiment of the invention, the bearing surfaces 56, 55, 44 and 58 of the latch 33 and the corresponding edges of the pivotally-mounted elements 30, 31 may have bevels or curves designed to facilitate engagement of the latch 33 in each of the positions and to take up any slack.

FIG. 3 shows that, in a preferred variant of the invention, the front wheels 7 and 10 are situated at least partially behind the line 40 that is the flexure line of the sole 2. During walking, the sole remains substantially plane behind this line, whereas the portion of the sole situated in front of said line 40 undergoes considerable flexing.

The wheels 7 and 10 situated under the front portion of the sole 2 are spaced apart to a small extent in order to leave a central zone 32 of the sole 2 intact, between the recesses 3, 5 designed to receive the front wheels 7, 10, which zone connects the deformable zone of the sole 2 that is situated in front of the flexure line 40 of the shoe 1 to the rear zone of the sole 2, which zone can be more rigid and is situated behind said flexure line 40. This zone 32 is designed to impart uniform flexing behavior to the sole 2, and to compensate for the weakening caused by the recesses 3 and 5 for receiving the wheels 7 and 10. This central zone 32 also bears some of the weight of the user during walking.

In order to enable wheels of large diameter to be used, it is possible to superpose them in part. This arrangement may be advantageous for the rear wheels 8, 9 situated under the heel that is narrower than the front of the sole. Thus, at least two wheels can be placed partially one above the other in the horizontal position for walking.

FIG. 5 is a cross-section view through the wheel 7 in the horizontal position for walking. The wheels 7, 8, 9, 10 preferably have hollow rims 22. In a preferred embodiment of the invention, a sole element 39 that is secured to or integral with the sole 2 and that is preferably cylindrical, may advantageously pass through the rim 22 of the wheel 7 and bear against the ground 41 when the wheels are in the horizontal position for walking.

In this way, the presence of the wheels reduces only slightly the area of contact between the sole and the ground.

Each wheel preferably has a tread strip 42 and a sidewall 38 extending towards the ground and designed to protect the wheel. For example, these elements 42 and 38 may be made of an elastic material of the rubber or polyurethane type.

Each rim 22 is secured to or integral with the hub 21, 23, 25 or 26 of the wheel in question. In FIG. 5, the rim 22 is connected to and constrained to pivot with the hub 21.

Preferably, the sidewall 38 of each wheel is raised relative to the ground when the wheels are in the horizontal position for walking. Thus, the wheels and the mechanism that supports them are not subjected to forces during normal walking, but rather only to occasional forces, e.g. on sandy ground.

FIG. 6 shows a second variant of the angular blocking device for angularly blocking the pivotally-mounted elements 30, 31. The latch 33 is pushed towards the segment 27 of the plate 60 by the spring 36. In accordance with the invention, the latch 33 has a spring blade 24 that is secured to or integral with it. Said spring blade 24 has a free position 24' shown in dashed lines. Under the action of the spring 36, the spring blade 24 is compressed and its end 37 pushes the pivotally-mounted element 30 into the vertical position. The position of the end 37 of the spring blade 24 is defined in such a manner that the wheel 7 is pressed hard against the end wall 59 of the recess in the sole 2. In this way, by means of the resilient thrust of the spring blade 24, any slack is taken up and the wheels 7, 8, 9, 10 are pressed resiliently against the end walls of their respective recesses in the horizontal position for walking, thereby avoiding any noise and clattering during walking or running.

Advantageously, a flexible cover (not shown) may cover the angular blocking device which then comprises the latch 33 and its hinge formed by the hub 53 and by the pin 54 and its spring 36. Said cover may also cover one or more other elements, such as the plate 60, the pivotally-mounted elements 30, 31, the longitudinal rods 15, 16 and/or the bearings 17, 18, 19, and 20. This cover enables the moving elements and the latch 33 to move, but it also protects them all from soiling and impacts.

All of the above-described characteristics enable the equipped sole to deform freely by flexing and twisting during walking, without such deformations giving rise to stresses on the mechanical components. In addition, the mechanical components such as the rods 15, 16, the bearings 17, 18, 19, 20, the pivotally-mounted elements 30, 31, 45, 49, and the angular blocking device 33, 47, 50, 52 are placed above the wheels 7, 8, 9, 10 and at the top of the sole 2, and the wheels do not touch the ground 41 under normal conditions. Thus, there is no risk of wear or of soiling.

These characteristics constitute a significant improvement relative to the prior art.

FIG. 5 shows that the center of gravity of the wheel 7 is offset relative to the longitudinal rod 15. Thus, in accordance with the invention, once the angular blocking device has been unlocked, e.g. by acting on the latch 33 that releases the pivotally-mounted elements 30 and 31, the longitudinal rods 15 and 16 are driven in pivoting by the off-axis weight of the wheels 7, 8, 9, 10. Such pivoting could also be caused by a resilient element acting on the pivotally-mounted elements, on the longitudinal rods, or on the wheels. The wheels 7, 8, 9, and 10 then, by gravity or by resilient drive, find themselves in an intermediate position. The angle of inclination of the wheels in this intermediate position, lies between the vertical and the horizontal.

In this intermediate position, vertical thrust from the shoe 1 on the wheels 7, 8, 9, 10 causes said wheels to be pressed under the sole 2 in the horizontal position for walking, and then causes the angular blocking device to be locked automatically under the action of the spring and of the latch 33. Conversely, lateral friction urging a wheel 7, 8, 9, or 10 outwards from the shoe causes the corresponding pivotally-mounted assembly to pivot into the vertical position for skating, and then causes the angular blocking device to be locked automatically in said vertical position.

When it is desired to obtain inclination of the wheels that is different from the inclination obtained merely by gravity, it is possible to place springs, for example, between the longitudinal rods 15, 16 and the non-moving plates. These springs drive the pivotally-mounted assemblies into their equilibrium position corresponding to the desired angular position.

FIG. 7 shows a third variant of the angular blocking device for angularly blocking the pivotally-mounted elements, seen from the rear. On the left side, the device is shown blocking the wheels 9, 10 in the horizontal position. On the right side, the device is blocking the wheels 7, 8 in the vertical position. Each pivotally-mounted element 45 is substantially in the shape of a quarter-disk centered on the axis of the corresponding longitudinal rod 15 or 16, and secured to said rod. A spring 47 that is preferably a double and symmetrical spring and that is secured to the segment 27 of the plate 60 comes into abutment against radial surfaces of the pivotally-mounted element 45 so as to block the pivoting. The pivotally-mounted element 45 is limited in pivoting in the other direction by a stud 46 secured to the flange 27. Thus, it suffices to press downwards on the spring 47, and more precisely on its two symmetrical branches, in order to release the pivoting of the pivotally-mounted assemblies and in order to cause the wheels 7, 8, 9, and 10 to pivot into the intermediate position.

This pressing can take place by means of a plurality of rods or cables such as 48, preferably actuated by a common button in order to act simultaneously on each of the springs 47.

In general and regardless of the nature of the angular blocking device, the convertible shoe of the invention is preferably provided with a single actuation button or lever that makes it possible to unlock the angular blocking device.

This actuation button or lever can be actuated manually, e.g. by tapping it against a curb or sidewalk or preferably by pressing it on a specially arranged zone of the other shoe.

The double and symmetrical spring 47 may be replaced with levers hinged to the center of the segment 27 and pushed against the pivotally-mounted elements 45 by springs.

FIG. 8 shows two other technical solutions making it possible to implement an angular blocking device for blocking the pivotally-mounted elements:

On the left side, in a fourth variant of the invention, the pivotally-mounted element 31 is of substantially elongate shape. It is blocked in position by a disk 52 guided in translation in the segment 27 of the plate 60 by means of a guide element 51 that is visible in FIG. 9.

By causing the disk 52 to slide upwards, the pivotally-mounted element is released so that it can pivot. A spring (not shown) automatically pushes the disk 52 into the locking position. The blocking disk 52 may have a beveled edge making it possible to facilitate engagement, or an edge that is substantially conical for the purpose of taking up any slack between the wheels and the end-walls 59 of the recesses in the sole.

On the right side, FIG. 8 shows a fifth variant of the invention, in which the pivotally-mounted element 49 is substantially in the shape of a quarter-disk. A blocking element 50, guided in horizontal translation on the segment 27 of the plate 60, is pushed by a spring against the pivotally-mounted element 49.

By causing the left and right blocking elements 50 to slide towards the middle of the segment 27, each pivotally-mounted assembly is released so that it can pivot. Each of the pivotally-mounted elements 49 has a lug 57 that limits the pivoting of the pivotally-mounted assemblies as soon as the wheels 7, 8, 9, 10 reach their vertical position, by coming into abutment against the corresponding blocking element 50.

In FIG. 3, the longitudinal rods 15 and 16 are shown straight. In a variant of the invention, the central portions of the rods, situated between the bearings 17, 19 and the hubs 23, 26, may match the curvature of the sole. In this way, the rods 15 and 16 are close to the sole 2 and can be pressed under it.

In order to improve the flexibility of the equipped sole, it is also possible to place hinges such as universal joints on the rods 15 and 16, in the vicinities of the bearings 17, 19 and of the hubs 23, 26.

In order to improve safety, it is possible to add additional locking that blocks the wheels 7, 8, 9, 10 in the horizontal position for walking. This locking may be constituted by latches that are actuated simultaneously by the latch 33 or by a separate lever, and that, for example, act directly on the rims 22.

FIGS. 10 and 11 show a variant having wheels that are steerable in pairs for going round a bend. The purpose is to obtain axle lines that that go onto a slant and, if possible, at least for one of them and in particular for the front axle line, that slant radially or approximately radially, i.e. in alignment or approximately in alignment with a radius of the bend circle or of the mean bend circle.

The wheels are thus steered correctly while going round a bend. In this way wear is limited and the balance of the skater wearing the shoes is improved while going round a bend.

In a variant shown in FIGS. 10 and 11, the inclination of the sole 2 causes the two pairs of wheels to be steered correctly, pair by pair, and any variation in inclination corresponds to a variation in steering of the pairs of wheels or at least of one pair of wheels. Skating round bends thus becomes more comfortable and safer.

It is possible to make a single pair of wheels steerable, and preferably to make the front pair steerable.

For this purpose, a device is added that makes it possible to cause the front and back plates 28 and 60 to pivot, or merely to cause one of them to pivot. These plates 28 and 60 or the one of them that is made movable are/is drivably connected to the sole 2 via a pin inclined at about 45° respectively forwards for the rear inclined pin 61 and rearwards for the front inclined pin 62. The connection is purely functional. It may be constituted merely by thrust. These pins are carried respectively by a rear non-moving plate 63 and via a front non-moving plate 64. These inclined pins are situated in the mid-plane of the sole 2 as visible in FIGS. 10 and 11.

Each of the inclined pins 61 and 62 carries at its end a bearing-forming part 65 and 66 acting by turning about its own axis and by being in contact with the corresponding pivotally-mounted plate so as to cause it to pivot in the desired direction, i.e. the direction determined by the inclination of the sole 2, thereby, for each inclined pin, causing the two wheels of the same pair of wheels to pivot simultaneously.

Thus, when the foot is inclined and thus when the sole 2 is inclined, each plate is driven in movement, e.g. by pivoting about its own axis by the effect of the bearing-forming part of the corresponding inclined pin.

The pivotally-mounted plates 28 and 60 are then no longer mutually parallel but rather their front and rear edges extend towards the center of the bend, and the shoe inclined rightwards or leftwards automatically describes a bend in the same direction.

Due to the wheels of the same pair of wheels being steered in the manner of a pivotally-mounted axle for each pair of wheels, the distances between the front and rear wheels become variable and freedom of movement needs to be provided via longitudinal rods 15 and 16 that are of variable length, e.g. that are extensible. By way of example, mention can be made of a fluting system guaranteeing rigidity in torsion while also enabling the bearings of the wheels along the same skating line to move towards each other or apart.

In addition, in order to accommodate the angular movements caused by the pivoting of the rear plate 60 and the front plate 28, the ends of the rods 15 and 16 are hinged, preferably via multidirectional hinges.

An example of extensible rods is shown in FIG. 10, in which it can be seen that two telescopic rods 15 and 16 are made in two portions 67 & 68 and 69 & 70 and their ends are provided with hinged connections of the universal joint type, referenced 71 & 72 at the rear and 73 & 74 at the front.

Since this angular mobility can be limited, it is possible to imagine a technological equivalent for a universal joint by elastic deformation of two parts or by deformation of intermediate or interposed elements procuring a flexible connection.

Clearly, the invention is not limited to the preferred embodiments described above and shown in the various figures, it being possible for the person skilled in the art to make numerous modifications to these embodiments and to imagine other variants without going beyond either the scope or the ambit of the invention as defined by the claims.

The invention claimed is:

1. A convertible shoe designed for walking and for roller-skating in alternation, said shoe comprising a sole in which recesses are provided, roller skate wheels which, for walking, are retracted into a horizontal position inside the recesses in the sole, and, for skating, are deployed under the sole into a vertical position, and a mechanism for actuating the wheels making it possible to cause the wheels to go from one position to the other in alternation by lateral pivoting, wherein:

in the vertical position for skating, the wheels are disposed on either side of the sole in the manner of a roller skate; and wherein the mechanism for actuating the wheels comprises:

two longitudinal rods disposed one on either side of the shoe and fastened to the sole via bearings enabling them to pivot about their own axes, each of these longitudinal rods carrying the wheels that are situated on the same side of the shoe in such a manner as to constrain them to pivot therewith;

two pivotally-mounted elements placed at the rear of the shoe, each of which is constrained to pivot with a respective one of the longitudinal rods, and is suitable for pivoting between two limit positions, one of which corresponds to the horizontal position of the wheels for walking, and the other of which corresponds to the vertical position of the wheels for skating; and an angular blocking device for angularly blocking the pivotally-mounted elements, which device, when it is unlocked releases the pivotally-mounted elements and allows them to pivot freely under the effect of gravity or of a force being exerted on the wheels, on the longitudinal rods or on the pivotally-mounted elements, and, when it is locked, blocks the pivotally-mounted elements simultaneously in one of their limit positions.

2. The convertible shoe according to claim 1, wherein the bearings are ball-joint or flexible-connection bearings.

3. The convertible shoe according to claim 1, wherein the longitudinal rods, the bearings, the pivotally-mounted elements and the angular blocking device are placed above the wheels and at the top of the sole.

4. The convertible shoe according to claim 1, wherein it further comprises a rear plate mounted on or incorporated in the sole, which plate has a substantially vertical segment disposed at the rear edge of the sole and serving to support the angular blocking device.

5. The convertible shoe according to claim 1, wherein each of the wheels has a sidewall and a hollow rim; and in that when the wheels are in the horizontal position for walking, a sole element serving to bear against the ground passes through each of the hollow rims, and the sidewalls are raised relative to the ground.

6. The convertible shoe according to claim 1, wherein the recesses have end walls and the convertible shoe further comprises resilient means that make it possible to urge the wheels resiliently to press against the end walls of their respective recesses in the horizontal position for walking.

7. The convertible shoe according to claim 1, wherein the sole of the shoe has a flexure line and between the recesses for receiving the front wheels, the sole has a central zone that is left intact, that connects the deformable zone of the sole situated in front of the flexure line of the shoe to the rear zone of the sole situated behind said flexure line, and that bears some fraction of the weight of the user during walking; and in that the front wheels are placed at least partially to the rear of said flexure line.

8. The convertible shoe according to claim 1, wherein it further comprises a single actuating button or lever that makes it possible to unlock the angular blocking device.

9. The convertible shoe according to claim 1, wherein when the angular blocking device is unlocked, the wheels are driven into an intermediate position by their own weight or by a resilient element; and in that vertical thrust on the wheels, or lateral friction urging the wheels outwards from the shoe causes the wheels-to go respectively into the horizontal position for walking or into the vertical position for skating, and causes the angular blocking device to be locked.

10. The convertible shoe according to claim 1, wherein it further comprises a flexible cover that covers at least one of the following elements: the pivotally-mounted elements, the angular blocking device, the longitudinal rods, and the bearings, in order to protect them from soiling and from impacts.

11. The shoe according to claim 1, wherein it has at least one pair of wheels that are steerable as a function of the inclination of the sole.

12. The shoe according to claim 11, wherein the steerable pair of wheels is the front pair.

13. The shoe according to claim 11, wherein:

the shoe comprises a rear plate mounted on or incorporated in the sole, and a front plate secured to the sole;

the wheels comprise hubs;

at least one of the rear plate and the front plate is pivotally mounted;

at least one non-moving plate is secured to the sole in the middle region of the zone of the pair(s) of rollers;

on said at least one non-moving plate there is mounted an inclined pin;

said at least one inclined pin co-operates with the corresponding moving plate with a view to steering the wheels;

the longitudinal rods are extensible; and the longitudinal rods are connected to the corresponding hubs of the wheels via multidirectional hinges.

14. The shoe according to claim 13, wherein said at least one inclined pin is inclined substantially at 45°.

15. The shoe according to claim 13, wherein the extensible longitudinal rods are telescopic.

16. The shoe according to claim 13, wherein the multidirectional hinges connecting the rods to the hubs of the wheels are of the universal joint type.

17. The shoe according to claim 13, wherein only the front plate is pivotally mounted, and there is only one inclined pin at the front.

* * * * *